United States Patent [19]

Arndt et al.

[11] Patent Number: 4,612,957

[45] Date of Patent: Sep. 23, 1986

[54] VACUUM PUMP AND TRAP COMBINATION

[75] Inventors: Lutz Arndt, Troisdorf; Paul Bachmann; Hanns-Peter Berges, both of Cologne; Wolfgang Leier, Bergisch Gladbach; Dieter Vorberg, Erftstadt-Lechenich, all of Fed. Rep. of Germany

[73] Assignee: Leybold-Heraeus GmbH, Cologne, Fed. Rep. of Germany

[21] Appl. No.: 695,909

[22] Filed: Jan. 29, 1985

[30] Foreign Application Priority Data

| | | | |
|---|---|---|---|
| Feb. 9, 1984 | [DE] | Fed. Rep. of Germany | 3404556 |
| Jul. 9, 1984 | [DE] | Fed. Rep. of Germany | 3425177 |
| Sep. 29, 1984 | [DE] | Fed. Rep. of Germany | 3435921 |

[51] Int. Cl.[4] ..... E03B 5/00

[52] U.S. Cl. ..... 137/565; 137/247.41; 137/247.49; 137/251.1; 92/83

[58] Field of Search ..... 137/565, 247.49, 251, 137/252, 253, 254; 92/83

[56] References Cited

U.S. PATENT DOCUMENTS

| | | | |
|---|---|---|---|
| 339,749 | 4/1886 | Edwards | 137/251 |
| 953,040 | 3/1910 | Krüger | 137/252 |
| 1,243,604 | 10/1917 | Houeywell | 137/252 |
| 2,620,749 | 3/1954 | Geriner | 137/254 X |
| 2,929,335 | 3/1960 | Seiler | 137/251 X |
| 3,802,165 | 4/1974 | Desplats | 137/254 X |
| 3,802,455 | 4/1974 | Zink | 137/251 |

*Primary Examiner*—Harold W. Weakley
*Attorney, Agent, or Firm*—Felfe & Lynch

[57] ABSTRACT

A vacuum pump and trap combination in which the trap is configured in the manner of a siphon and comprises a tube immersed in trap liquid but having an opening lying above the trap liquid level. The tube has a wall section lying below the trap liquid level and having perforations therein to admit different amounts of trap liquid in relation to the rate of discharge gas flow, thereby preventing frothing of the trap liquid.

3 Claims, 5 Drawing Figures

VACUUM PUMP AND TRAP COMBINATION

This invention relates to a vacuum pump and trap combination.

Vacuum pumps often serve for the pumping of reactive gases which react especially with moisture and/or oxygen. In such reactions, solids can form which deposit themselves in the area of the discharge of the vacuum pump, first narrowing it and ultimately stopping it up. Furthermore, these solids can considerably reduce the life of the vacuum pump by their mechanical action. These reactions, however, can also result in liquid or gaseous substances which have a corrosive action on the materials of which the vacuum pump is made or, if it is a liquid-sealed vacuum pump, impair the properties of the sealing liquid; for example, titanium chloride can react with moisture to form corrosive hydrochloric acid and solid titanium dioxide. Another example of the formation of a solid residue is the reaction of silane with oxygen to form silicon dioxide. In the case of the presence of $SiH_2Cl_2$, reactions with water occur whereby hydrochloric acid and solid silicon dioxide are formed.

The present invention is addressed to the problem of equipping a vacuum pump such that the described disadvantages will no longer be able to occur.

This problem is solved in accordance with the invention preferably by disposing at the discharge of the vacuum pump a trap configured in the manner of a siphon, which prevents the entry of water vapor or oxygen.

A vacuum pump equipped with such a trap is completely protected against moisture or oxygen. Undesirable reactions resulting in solid deposits or corrosive substances can therefore no longer take place within the vacuum pump. In accordance with the invention, the reactive gases or vapors handled by the pump flow from the discharge of the vacuum pump to the trap of the invention and pass through the liquid present therein, which prevents the entry of moisture or oxygen into the vacuum pump. The reaction zone between the reactive gases or vapors and the moisture or oxygen is thus shifted away from the vacuum pump to a simple external component which can be made, for example, of corrosion-resistant parts. Substances which form solids in reactions with moisture or oxygen and which, without the trap of the invention, would clog the discharge of the vacuum pump, deposit themselves in the casing of the trap of the invention. In comparison with an unprotected discharge of the vacuum pump, the capacity of the trap of the invention up to the point of clogging is greater at least by a factor of 20. By regular maintenance of this external component, clogging can easily be prevented.

An important advantage of the trap of the invention is that the vacuum pump is protected against moisture or oxygen even when the pump is operating at low aspiration pressures and hence low gas flow or is not operating. Without the trap of the invention, moisture or oxygen can diffuse under these circumstances back into the pump, and this takes place to a considerable extent especially when an apparatus filled with water or aqueous solutions used for capturing the reactive gases or vapors to protect the environment is connected to the discharge of the vacuum pump.

It would be conceivable to protect the vacuum pump against the penetration of moisture or oxygen by means of valves or flaps in the discharge line. In this case, however, there is the disadvantage that the critical reaction zone between the pumped gases on the one hand and the moisture or oxygen on the other would be in the area of these flaps or valves, so that their operation would be very rapidly impaired by corrosion or the formation of coatings. If such a valve fails to open, an unacceptably high pressure develops inside of the vacuum pump and can result in explosive destruction.

A tube with its end immersed in the trap liquid is a reliable trap for the vacuum pump. At a low output, the exhausted gas stream passes through the liquid in the form of bubbles. At a higher output, however, the danger exists that the liquid will froth and/or that drops of the liquid will be entrained by the gas stream. To prevent this, the trap could be made sufficiently large. However, an especially advantageous solution consists in bending the tube adjacent the end immersed in the liquid such that its terminal orifice will be above the level of the trap liquid, and that its wall below the level of the trap liquid contains perforations. By the perforations or holes, which are preferably disposed in the upper portion of the tube wall, the trap liquid enters into the tube and produces the desired seal. In the event of high gas flows, the liquid plug inside of the tube is ejected, so that the tube no longer contains any liquid. In this phase of operation the presence of the liquid plug is no longer necessary, since the return of harmful vapors is reliably prevented by the high gas velocity.

It is desirable that the straight section of the tube that is below the level of the liquid be inclined slightly downwardly with respect to the direction of flow of the gas stream and with respect to the horizontal. If this is the case, the liquid level within the submerged tube will always uncover only the number of perforations which is necessary for the emergence of the gases flowing through the submerged tube. Undesirable movements of the liquid and the undesirable turbulence which they entail are thereby prevented.

In accordance with the invention, a vacuum pump and trap combination comprises a vacuum pump with suction inlet and discharge outlet, and a trap configured in the manner of a siphon and preventing the entry of water vapor or oxygen and disposed following the discharge outlet in communication therewith.

For a better understanding of the present invention, together with other and further objects thereof, reference is made to the following description, taken in connection with the accompanying drawings, and its scope will be pointed out in the appended claims.

Referring now to the drawings.

Figure 1:
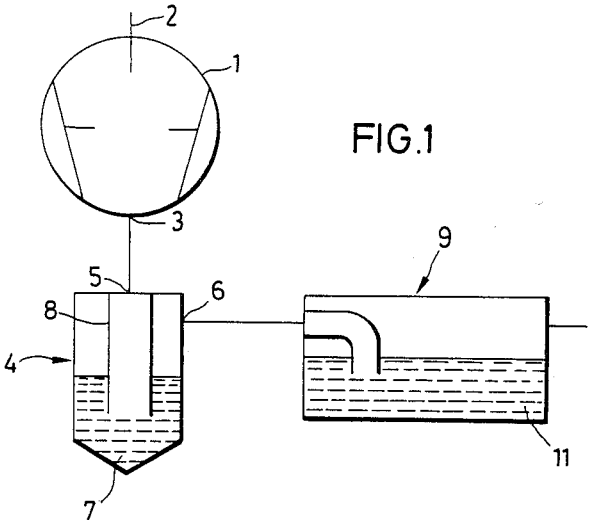
FIG. 1 is a diagrammatic view of an embodiment of a vacuum pump and trap combination constructed in accordance with the invention.

FIG. 1 represents diagrammatically a vacuum pump 1 with suction 2 and discharge 3. To the discharge 3 is connected the trap 4, whose inlet is marked 5 and whose outlet is marked 6. The trap liquid 7 is situated in the trap 4. The tube 8, connected with the inlet 5, reaches into the trap liquid 7. The entering gas passes through the trap liquid 7 and leaves the trap 4 through the outlet 6. The trap liquid 7 assures that moisture or oxygen will be unable to pass from the outlet 6 to the inlet 5. Suitable trap liquids are mineral oils, technical white oils, perfluorinated polyethers, silicone oils or, in general, liquids which are immiscible with water, indissoluble in water and do not absorb water or are not hygroscopic. The vacuum pump 1 can be a dry-running pump or a liquid-sealed vacuum pump. Many different oils, ethers or esters can be used as sealing liquids.

In the embodiment represented in FIG. 1, the trap 4 is attached to an apparatus whereby reactive gases or vapors can be intercepted to protect the environment. For this purpose the exhaust gases from the vacuum pump 1 can be carried through a liquid 11 having properties appropriate for the purpose. Suitable liquids are water or aqueous solutions of substances which bind the gases that are to be trapped.

Figure 2:
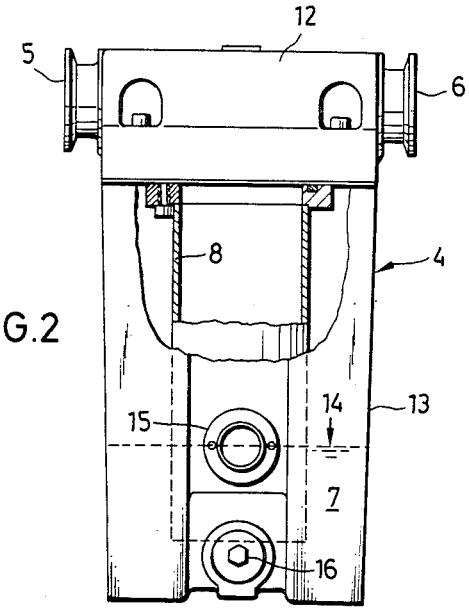
FIG. 2 is a fragmentary elevational view, partly in section, of the trap of the FIG. 1 embodiment.

FIG. 2 shows details of an embodiment of the trap 4. It includes an upper and a lower casing section 12 and 13, respectively. The inlet 5 and the outlet 6 are on the upper casing section. The inlet 5 communicates with the interior of the tube 8 which preferably is removably fastened to the upper casing section. In the lower casing section 13 is the trap liquid 7 into which one end of the tube 8 is immersed. The spy-hole 15 preferably is provided for examining the level 15 of the trap liquid. A trap liquid drain plug 16 preferably is provided. The annular chamber formed by the bottom casing section 4 and the tube 8 is in communication with the outlet 6.

Figure 3:
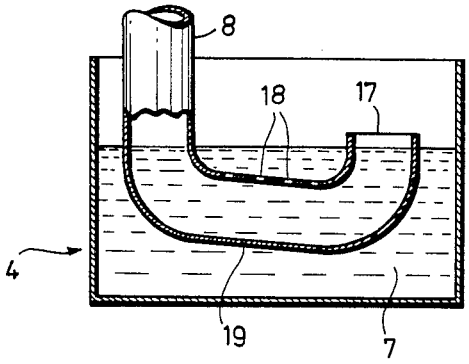
FIGS. 3, 4 and 5 are fragmentary elevational views, partly in section, of the trap of the FIG. 1 embodiment.
Figure 4:
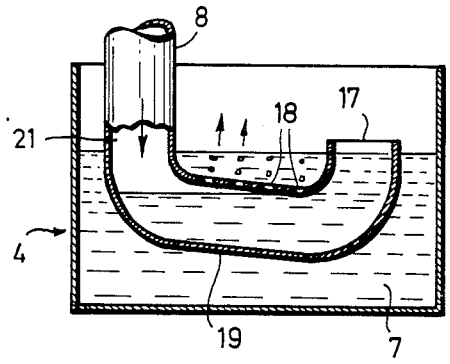
Figure 5:
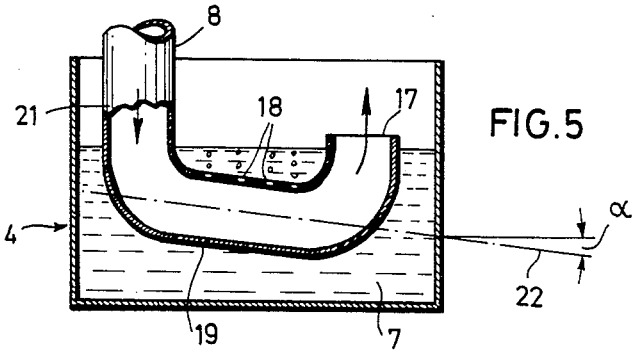

FIGS. 3 to 5 show an embodiment in which the tube 8 is bent such that its end orifice 17 is above the level of the trap liquid 7. To permit the entry of trap liquid into the tube, the perforations or holes 18 preferably are provided, which are disposed preferably in the upper portion of the submerged section of the tube.

The portion of the tube 8 lying below the trap liquid level preferably has a straight section 19 whose upper side is equipped with the perforations 18. With respect to the direction of the flowing gases, indicated by the arrows 21, and with respect to the horizontal 22, the section 19 preferably slopes slightly downward. Thus, it preferably is achieved that always only a portion of the perforations 18 will be exposed that corresponds to the strength of the gas stream.

FIGS. 3 to 5 show different states of operation. FIG. 3 shows the state in which the pump is not running. The tube 8 is filled with liquid and constitutes a secure plugging of the tube 8 and thus of the vacuum pump. FIG. 4 shows the state at a low rate of flow of the gas. The gas passes through a portion of the perforations 18 corresponding to the strength of the gas stream. The pump is also protected against back-flow.

Lastly, FIG. 5 shows the state at a high rate of gas flow. The tube 8 is cleared of trap liquid. Frothing of the trap liquid or entrainment of liquid droplets is prevented. The pressure prevailing in section 19 due to the high rate of flow of the gas prevents the entry of trap liquid through the openings 18. If necessary, the pressure can be influenced by means of a throttle disposed adjacent the opening 17, which has the effect of increasing the pressure in the tube 8.

Also in this state of operation the pump is protected against back-flow, since due to the high gas velocity in the tube 8 the return of harmful vapors is reliably prevented. If the gas flow is reduced again, liquid automatically flows back into the tube 8 through the openings 18 according to the reduced velocity and thus assures the trapping at low or even zero pump output.

Since in the embodiment represented in FIGS. 3 to 5 the entire gas flow does not have to be pumped through the trap liquid when the rate of flow of the gas is high, frothing of the trap liquid is not produced. Moreover, it is possible to make the apparatus relatively small in size.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A vacuum pump and trap combination comprising:

a vacuum pump with suction inlet and discharge outlet; and a trap configured in the manner of a siphon and preventing the entry of water vapor or oxygen and disposed following said discharge outlet in communication therewith, said trap including a casing partially filled with a trap liquid and a dip tube disposed therein, said dip tube being bent adjacent an end thereof immersed in trap liquid and having a terminal opening lying above the trap liquid level, and having a wall section lying below the trap liquid level and having perforations therein.

2. A vacuum pump and trap combination in accordance with claim 1, in which said perforations are disposed in an upper portion of said wall section lying below the trap liquid level.

3. A vacuum pump and trap combination in accordance with claim 1, in which the portion of said dip tube that lies below the level of the trap liquid has a straight section which slopes slightly with respect to the direction of the output gas stream and with respect to the horizontal.

* * * * *